United States Patent [19]

Kokubo

[11] 4,363,584

[45] Dec. 14, 1982

BEST AVAILABLE COPY

[54] PAPER SHEET ACCUMULATOR ASSEMBLY AND BANK NOTE DISPENSER PROVIDED THEREWITH

[75] Inventor: Eiichi Kokubo, Tokyo, Japan

[73] Assignee: Laurel Bank Machine Co., Ltd., Tokyo, Japan

[21] Appl. No.: 190,265

[22] Filed: Sep. 24, 1980

[30] Foreign Application Priority Data

Sep. 25, 1979 [JP] Japan ..... 54-122910
Sep. 25, 1979 [JP] Japan ..... 54-122911

[51] Int. Cl.[3] ..... B65H 29/40; B65H 31/08; B65H 31/30

[52] U.S. Cl. ..... 414/33; 194/DIG. 26; 221/252; 271/5; 271/9; 271/212; 271/279; 271/315; 414/43; 414/93

[58] Field of Search ..... 271/212, 315, 187, 9, 271/4, 5, DIG. 9, 178, 279, 299, 303; 414/93, 92, 43, 32, 33; 221/176, 252; 194/DIG. 26

[56] References Cited

U.S. PATENT DOCUMENTS

| | | | |
|---|---|---|---|
| 3,174,749 | 3/1965 | Childs | 271/212 X |
| 3,568,860 | 3/1971 | Rawlins | 271/212 X |
| 3,952,183 | 4/1976 | Abe | 271/212 X |
| 4,066,253 | 1/1978 | Lundbald et al. | 271/4 |
| 4,150,757 | 4/1979 | Laybourn et al. | 271/187 X |
| 4,228,997 | 10/1980 | Schoonmaker et al. | 271/187 X |
| 4,253,655 | 3/1981 | Nishimoto | 271/178 X |

*Primary Examiner*—Bruce H. Stoner, Jr.
*Attorney, Agent, or Firm*—Fleit & Jacobson

[57] ABSTRACT

A paper sheet accumulator assembly for successively underlaying paper sheets in good order at a collection station which has a paddle wheel disposed downstream of a conveyor belt assembly for delivering paper sheets, such as bills of money, to the accumulator assembly. The paddle wheel has a number of overlapping paddles which receive paper sheets on their underside, and which are accumulated and released by an abutting plate. In use as a bank note discharge ports provided on opposite side walls of the frame of the dispenser, allowing a bundle of bank notes to be dispensed from either of the discharge ports as desired.

5 Claims, 7 Drawing Figures

PAPER SHEET ACCUMULATOR ASSEMBLY AND BANK NOTE DISPENSER PROVIDED THEREWITH

BACKGROUND OF THE DISCLOSURE

There is provided a paper sheet accumulator assembly for successively underlaying paper sheets in good order at a collection station, comprising at least one paddle wheel disposed downstream of a conveyer belt assembly for delivering paper sheets to the accumulator assembly and having a plurality of swirling paddles overlapping with each other, said paddle wheel being carried for rotating to receive paper sheets underside of said paddles such that one paper sheet is inserted under each paddle, an abutting plate disposed adjacently to said paddle wheel for abutting against the leading ends of the paper sheets inserted underside of said paddles, and a kick roller for pushing the paper sheets and kicking the trailing ends of the paper sheets upward to kick out them from the underside of the paddles. The paper sheet accumulator assembly of the invention is suitable for use in a bank note dispenser. Also provided is a bank note dispenser provided with the aforementioned paper sheet accumulator assembly and having two bank note discharge ports provided at the opposed side walls of the frame of the dispenser, whereby a bundle of bank notes may be dispensed from either of the discharge ports selectively as desired.

BACKGROUND OF THE INVENTION

1. Field of the Invention

The present invention relates to a paper sheet accumulator assembly which is particularly suitable for use in an automatic cash dispenser or in a money exchanger. It is further directed to a bank note dispenser provided with a bank note accumulator assembly for provisionally accumulating the pre-set number of bank notes underlaid coextensively with one another and then dispensing the thus formed bundle of bank notes selectively along two different passages through one of the two discharge ports provided on the different sides, for example, on the side wall of the machine frame facing to the outside of the building to which the machine is installed and on the side wall of the machine frame facing to the inside, for instance, the lobby or hall of the building.

2. Prior Art

In the conventional bank note accumulator assembly, conveyer belts, kick rollers and an abutting plate are used to temporarily accumulate bank notes.

However, the conventional paper sheet accumulator assembly of this kind has a disadvantage in that the succeeding paper sheet tends to be caught by the damaged portion of the lowermost paper sheet of the accumulated paper sheets to jam the paper sheet accumulator assembly or to be underlaid in a disturbed order. Damages causing such jamming or misalignment include a downward fold as shown at the right corner of the leading end and other various disorders such as breakage, crease or undulation of any one of the paper sheets. The aforementioned disadvantage of the conventional paper sheet accumulator assembly is resulted from the inherent fault thereof in that the succeeding paper sheet just being underlaid is pushed underside of the lowermost paper sheet while contacting with the bottom face of the latter. A further problem of the known assembly resides in the difficulty encountered when handling soft or flexible sheets.

Bank notes dispenser provided with paper sheet accumulator assembly are also known. One type of bank note dispenser (exterior-type dispenser) may be installed in a bank or like facilities with the port facing to be exposed to the outside of the building in which it is installed through an opening or through-hole provided on the exterior wall of the building in response to the manupulation of the operation panel by a customer, whereas the stackers are assembled in the bank note dispenser from the inside of the building by an authorized operator. In another type bank note dispenser (lobby-type dispenser), both of a bank note discharge port and bank note stackers are arranged on the same side of the dispenser so that setting of the stackers by an authorized member of staff of the bank may be performed from the front side of the dispenser, said front side being the same as that accessible by any customer of the bank who desires to be paid with bank notes using his cash card. This type bank note dispenser can be installed in a lobby or hall of a bank while being oriented such that the front side faces inboard of the lobby or hall and the rear side faces the wall.

However, it is inconvenient to install the aforementioned one type of dispenser in place of the aforementioned another type of dispenser or vise versa, since the bank note stackers S or S′ must be disposed so as to face the wall of the building. For this reason, two different types of bank note dispenser have been manufactured to meet with the demands for the exterior-type dispenser on the one hand and for the lobby-type dispenser on the other hand. It should be of practical value if a bank note dispenser which may be selectively or concurrently used as the exterior-type dispenser and as the lobby-type dispenser is provided. There is an increasing demand for such a so-called two-way dispenser. However, such two-way dispenser provided with a simple mechanism for selectively dispensing a bundle of bank note along different two passages has not been commercially manufactured due to the difficulty in provision of simple and yet reliable mechanism which may be incorporated in a bank note dispenser.

SUMMARY AND OBJECT OF THE INVENTION

A primary object of the present invention is to provide a paper sheet accumulator assembly for provisionally accumulating a pre-set number of paper sheets precisely and reliably without jamming or misalignment of the paper sheets frequently occurred with the use of a conventional paper sheet accumulator device.

A secondary object of the present invention is to provide a bank note dispenser having the paper sheet accumulator assembly of the aforementioned kind and means for selectively feeding the thus accumulated bank notes along one passage directing to a first discharge port and along the other passage directing to a second discharge port.

The primary object of the present invention can be attained, according to the invention, by the provision of a paper sheet accumulator assembly for successively underlaying paper sheets in good order at a collection station, comprising at least one paddle wheel disposed downstream of a conveyer belt assembly for delivering paper sheets to the accumulator assembly and having a plurality of swirling paddles overlapping with each other, said paddle wheel being carried for rotating to receive paper sheets underside of said paddles such that one paper sheet is inserted under each paddle, an abutting plate disposed adjacently to said paddle wheel for abutting against the leading ends of the paper sheets inserted underside of said paddles, and a kick roller for pushing the paper sheets and kicking the trailing ends of the paper sheets upward to kick out them from the underside of the paddles.

The secondary object of the present invention can be attained, according to the invention by the provision of a bank note dispenser having first and second discharge ports provided at the opposed side walls of the frame of the dispenser, which comprises a plurality of bank note stackers each stocking a single specie of bank notes, suction means for sucking a selected kind of bank notes successively from a selected stacker selected from said plurality of bank note stackers, first conveyer means for receiving the bank notes from said suction means to convey the same, a bank note accumulator assembly for successively receiving the bank notes conveyed by said first conveyer means to underlay the same in good order at a collection station to form a bundle of bank notes, second conveyer means for conveying said bundle of bank notes from said collection station selectively along a passage directing to said first discharge port, and third conveyer means for conveying said bundle of bank notes from said collection station selectively along a passage directing to said second discharge port, said bank note accumulator assembly including a paddle wheel disposed downstream of said first conveyer means for delivering bank notes to the accumulator assembly and having a plurality of swirling paddles overlapping with each other, said paddle wheel being carried for rotating to receive bank notes underside of said paddles such that one bank note is inserted under each paddle, an abutting plate disposed adjacently to said paddle wheel for abutting against the leading ends of said bank notes inserted underside of said paddles, and a kick roller for pushing the bank notes and kicking the trailing ends of said bank notes upward to kick out them from the underside of the paddles.

DESCRIPTION OF THE DRAWING

The above and other objects and advantages of the present invention will become apparent from the following detailed description of the preferred embodiments with reference to the accompanying drawings, in which.

DESCRIPTION OF THE PREFERRED EMBODIMENT

For better understanding of the present invention, conventional paper sheet accumulator assembly and bank note dispensers will be first explained with reference to FIGS. 1 to 3.

Figure 1:
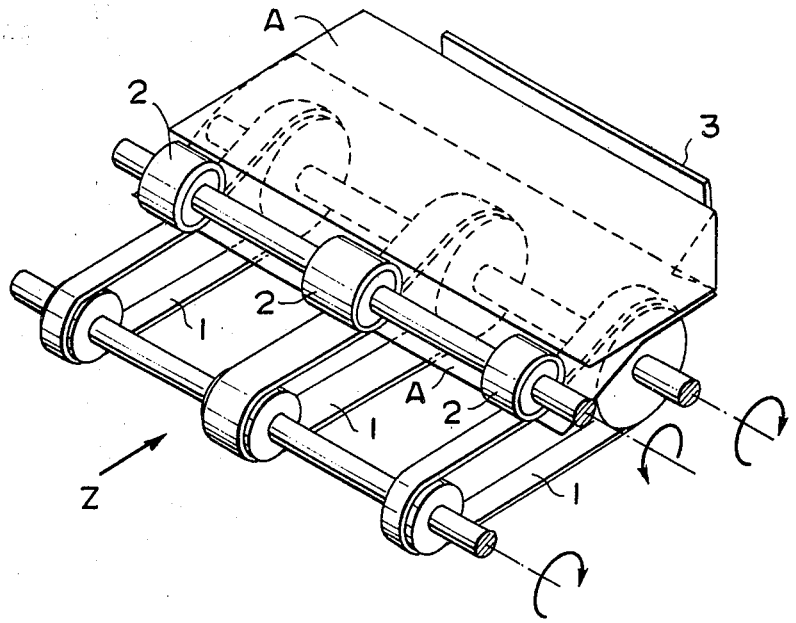
FIG.1 PRIOR ART
FIG. 1 is a diagrammatical view showing an example of the conventional paper sheet accumulator assembly.

A representative example of the paper sheet accumulator assembly which has hitherto been used in a bank note counting apparatus or in a cash dispenser is shown in FIG. 1. In the conventional bank note accumulator assembly shown in FIG. 1, each of the bank notes A successively fed in-between a conveyer belt 1 and a kick roller 2 is conveyed in the direction shown by the arrow Z in the Figure so that the leading end of each bank note abuts against an abutting plate 3. By the relative abutting action of the leading ends of bank notes and the abutting plate 3, the edges of the leading ends of the bank notes are substantially aligned and the bank notes are underlaid successively below the preceding bank notes coextensively or in a face-to-face relationship. The spacing between the abutting face of the plate 3 and the kick roller 2 is adjusted such that the trailing end of each bank note is kicked upward by the action of the kick roller 2 when the leading end thereof abuts against the plate 3. Thus, a desired number of bank notes is accumulated at a collection station in order while the leading ends of the bank notes are abutting against the plate 3.

However, the conventional paper sheet accumulator assembly of this kind has a disadvantage in that the succeeding paper sheet tends to be caught by the damaged portion of the lowermost paper sheet of the accumulated paper sheets to jam the paper sheet accumulator assembly or to be underlaid in a disturbed order. Damages causing such jamming or misalignment include a downward fold as shown at the right corner (when viewed in FIG. 1) of the leading end and other various disorders such as breakage, crease or undulation of any one of the paper sheets. The aforementioned disadvantage of the conventional paper sheet accumulator assembly is resulted from the inherent fault thereof in that the succeeding paper sheet just being underlaid is pushed underside of the lowermost paper sheet while contacting with the bottom face of the latter. A further problem of the known assembly resides in the difficulty encountered when handling soft or flexible sheets.

Figure 2:
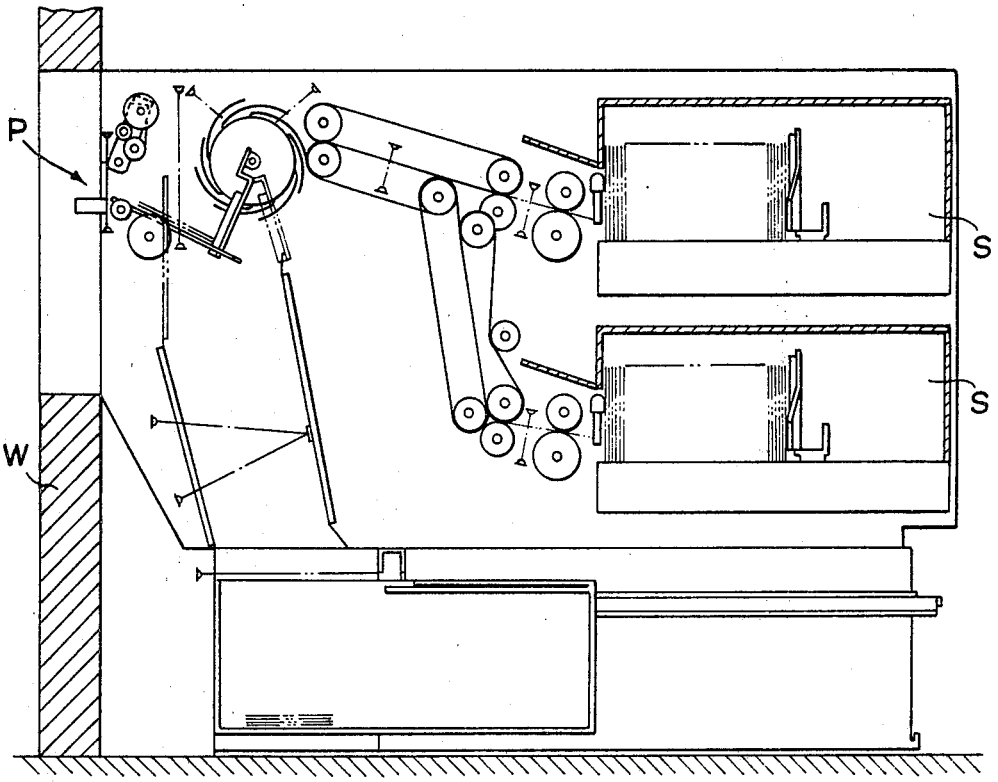
FIG.2 PRIOR ART
FIG. 2 is a diagrammatical side elevation showing an exterior-type bank note dispenser of the prior art provided with a paper sheet accumulator assembly of the present invention but has only a single bank note discharge port.
Figure 3:
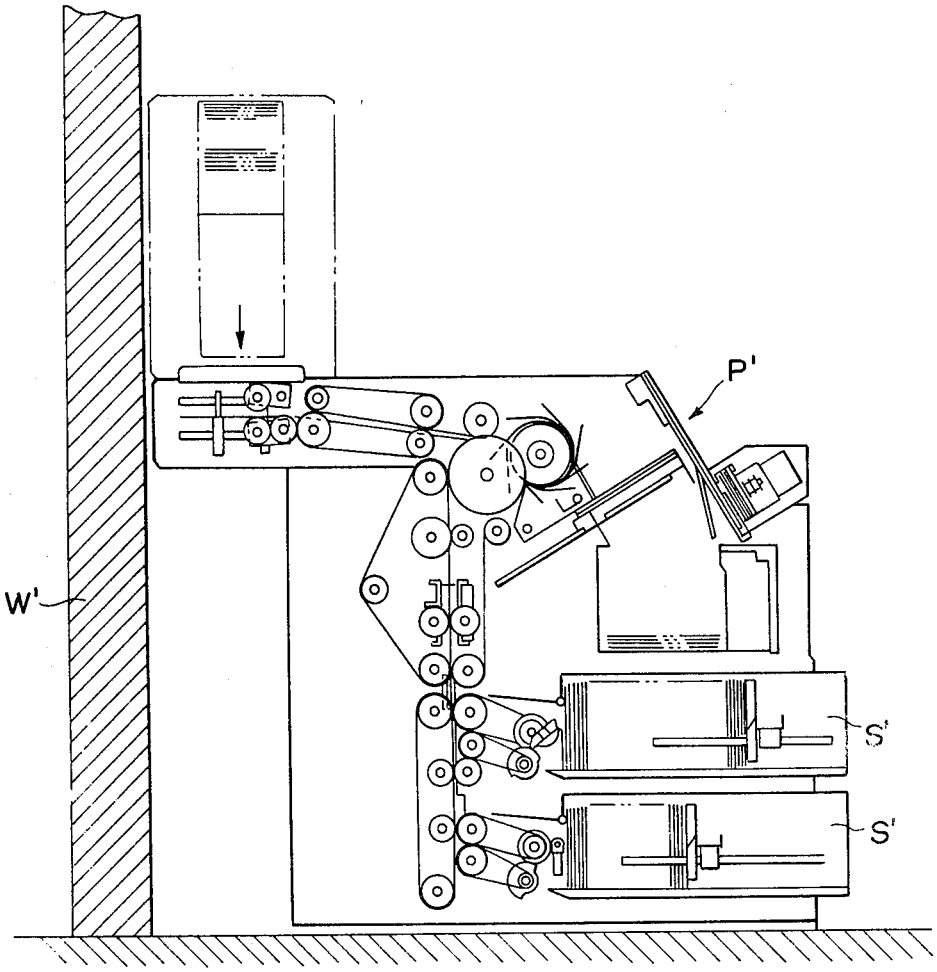
FIG. 3 PRIOR ART
FIG. 3 is a diagrammatical side elevation showing a lobby-type bank note dispenser of the prior art provided with a paper sheet accumulator assembly of the present invention but has only a single bank note discharge port.

In the meanwhile examples of known bank notes dispenser provided with paper sheet accumulator assembly are schematically shown in FIGS. 2 and 3. A bank note dispenser shown in FIG. 2 is provided with the paper sheet accumulator assembly and the accumulator assembly is disposed adjacent a single bank note discharge port P. In this type of conventional bank note dispenser, the discharge port P is opened at the side opposed to the side at which a plurality of bank note stackers S is disposed. Each kind of bank notes is charged in each stacker which is detachably mounted to the operable position to supply bank notes as requested. This type of bank note dispenser (hereinafter referred to as exterior-type dispenser) may be installed in a bank or like facilities with the port P facing to be exposed to the outside of the building in which it is installed through an opening or through-hole provided on the exterior wall W of the building in response to the manupulation of the operation panel by a customer, whereas the stackers S are assembled in the bank note dispenser from the inside of the building by an authorized operator. Another type bank note dispenser is shown in FIG. 3 (hereinafter referred to as lobby-type dispenser). In this type bank note dispenser, both of a bank note discharge port P' and bank note stackers S' are arranged on the same side of the dispenser so that setting of the stackers S' by an authorized member of staff of the bank may be performed from the front side of the dispenser, said front side being the same as that accessible by any customer of the bank who desires to be paid with bank notes using his cash card. This type bank note dispenser can be installed in a lobby or hall of a bank while being oriented such that the front side (the right side as viewed in FIG. 3) faces inboard of the lobby or hall and the rear side faces the wall W'.

However, it is inconvenient to install the dispenser shown in FIG. 2 in place of the dispenser shown in FIG. 3, or vise versa, since the bank note stackers S or S' must be disposed so as to face the wall of the building. For this reason, two different types of bank note dispenser have been manufactured to meet with the demands for the exterior-type dispenser on the one hand and for the lobby-type dispenser on the other hand. It should be of practical value if a bank note dispenser which may be selectively or concurrently used as the exterior-type dispenser and as the lobby-type dispenser is provided. There is an increasing demand for such a so-called two-way dispenser. However, such two-way dispenser provided with a simple mechanism for selectively dispensing a bundle of bank note along different two passages has not been commercially manufactured due to the difficulty in provision of simple and yet reliable mechanism which may be incorporated in a bank note dispenser.

The present invention will now be described in detail by referring to a preferred embodiment thereof shown in FIGS. 4 to 7.

Figure 4:
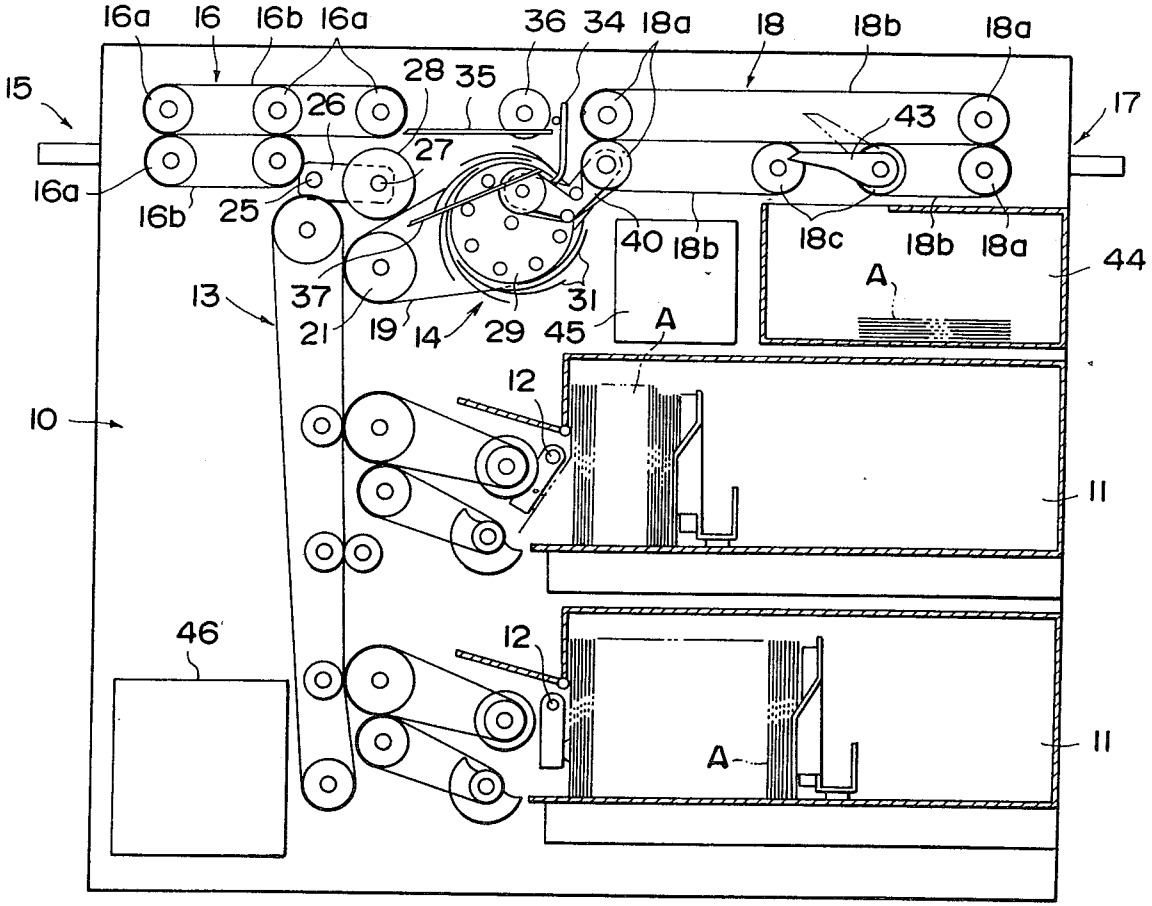
FIG. 4 is a diagrammatical side elevation showing an embodiment of the bank note dispenser according to the present invention wherein an embodiment of the paper sheet accumulator assembly of the invention is incorporated.

Firstly referring to FIG. 4, showing a bank note dispenser embodying the present invention, the bank note dispenser generally denoted at 10 comprises bank note stackers 11, 11 each for storing single kind bank notes A and adapted to be detachably mounted to the body of the bank note dispenser 10, suction heads 12, 12 for successively sucking bank notes A one by one to feed the same to a conveyer line 13, a bank note accumulator assembly 14 for successively underlaying bank notes A conveyed thereto through the conveyer line 13 in good order at a collection station, a first discharge port 15, a conveyer belt 16 for conveying a bundle of accumulated bank notes to the first discharge port 15, a second discharge port 17, and a conveyer belt 18 for conveying the bundle of accumulated bank notes to the second discharge port 17.

Figure 5:
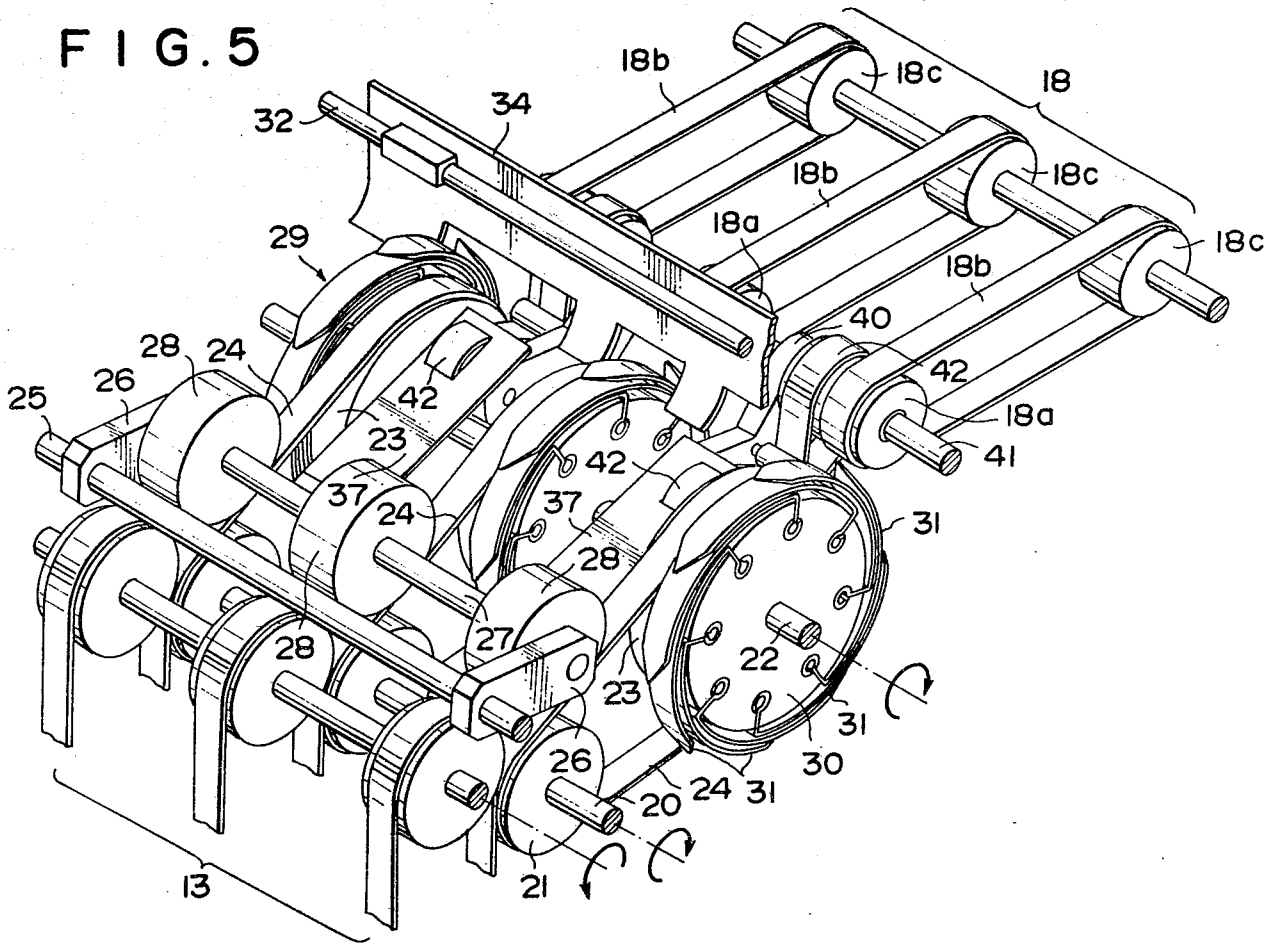
FIG. 5 is a perspective view showing the main parts of the paper sheet accumulator assembly incorporated in the bank note dispenser shown in FIG. 4.
Figure 6:
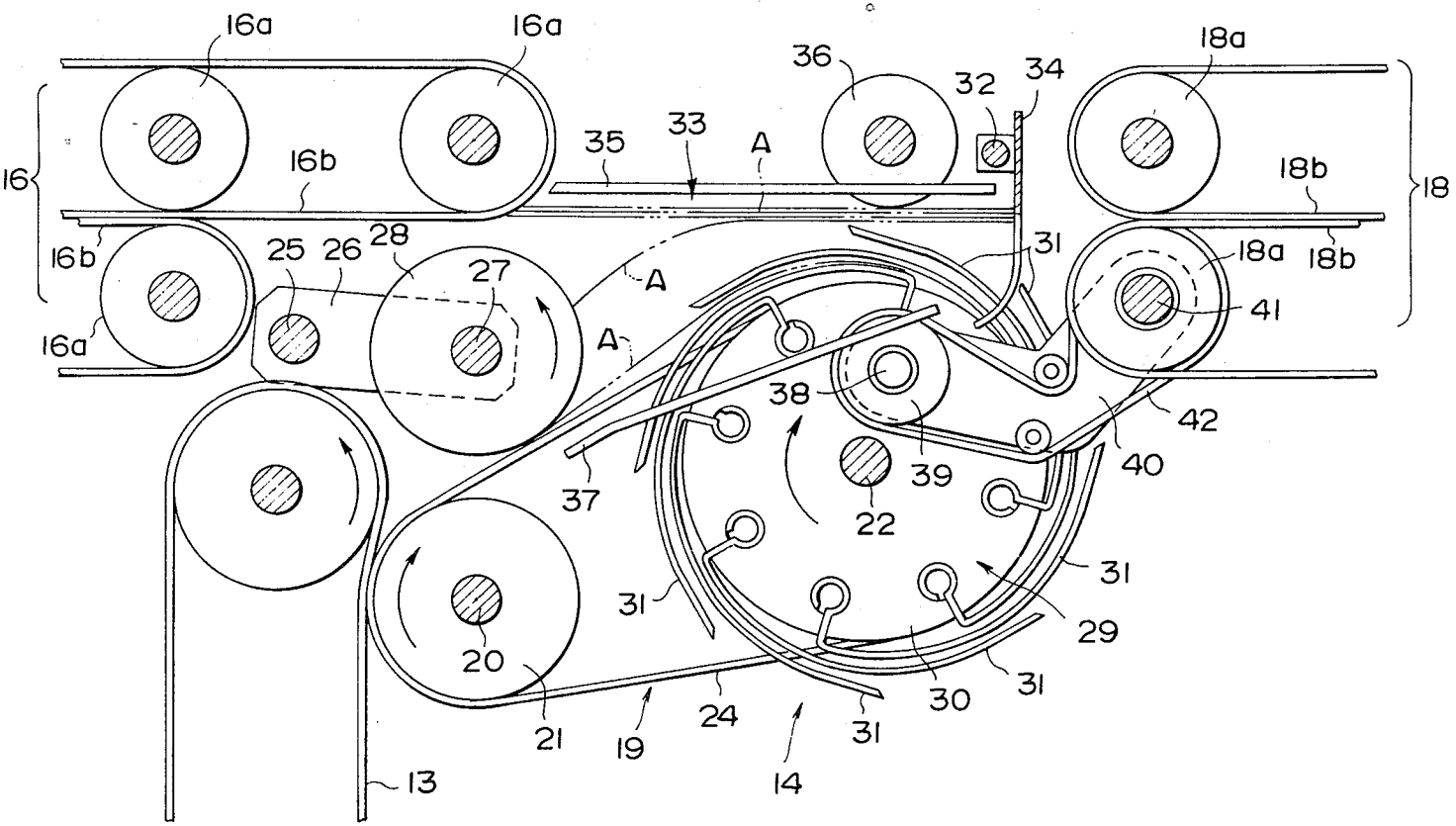
FIG. 6 is a side elevation of the assembly shown in FIG. 5 and showing the operation of accumulating bank notes by actuating the paper sheet accumulator assembly.
Figure 7:
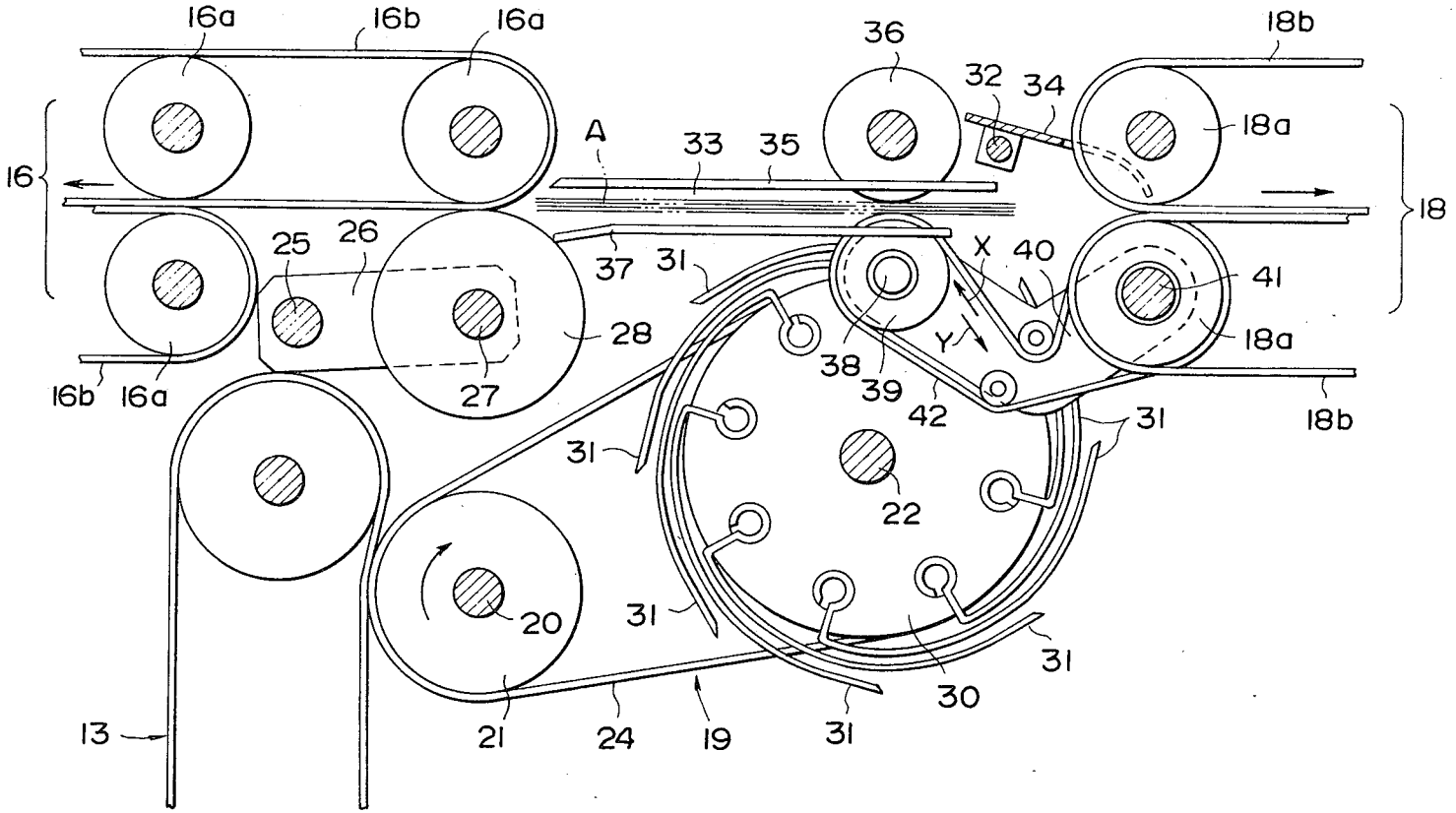
FIG. 7 is a view similar as FIG. 6 but showing the operation of feeding the bundle of accumulated bank notes to the bank note discharge port.

Details of the bank note accumulator assembly 14 are shown in FIGS. 5 to 7. A conveyer assembly 19 is arranged adjacently to the forehand end of the conveyer line 13 to receive bank notes A successively one by one. This conveyer assembly 19 is composed of a plurality of pulleys 21 mounted on a shaft 20 disposed near the forehand end of the conveyer line 13, pulleys 23 mounted on a shaft 22 at the positions opposite to the pulleys 21, and belts 24 trained over the pulleys 21 and 23. A support shaft 25 extends generally parallel to the shaft 20 above the conveyer assembly 19 and carries arms 26, 26 to which another shaft 27 is rotatably mounted. A plurality of kick rollers 28 are mounted on the shaft 27. On the pulleys 23 also fixedly mounted are paddle wheels 29 which are rotated together with the pulleys 23. Each of the paddle wheels 29 comprises a disk 30 and a multiplicity of paddles 31 implanted to the disk 30. Each of the paddles 31 is bent and swirled in the direction reverse to the rotating direction of the paddle wheel 31 to be gradually separated from the outer periphery of the disk 30. Between the lower face of each paddle 31 and the upper face of the next underlaid paddle 31 formed is a gap into which a bank note A may be inserted. A rotary shaft 32 is disposed above the paddle wheel 29 (in the upper right position of the latter when viewed in FIG. 6). An abutting plate 34 is mounted to this shaft 32 so as to abut the leading ends of respective bank notes A as they are pushed out of the paddles 31 to underlay one after another to accumulate them at an accumulation station 33 in good order. The abutting plate 34 has a flat base portion normally oriented vertically during the accumulation operation and also has downward projecting lugs of generally arcuated shape, the lugs being positioned between the paddle wheels 29 to scoop the leading ends of the bank notes pushed out of the respective paddles. At the accumulation station 33 above the paddle wheels 29, there is arranged an upper guide plate 35, and a discharge roller 36 is rotatably mounted with its lower peripheral portion projecting below the upper guide plate 35. Lower guide plates 37 are swingably carried by a shaft 38 on which pulleys 39 are mounted having their upper peripheral portions projecting beyond the upper guide plates 37. The shaft 38 is carried by one ends of arms 40, and the other ends of the arms 40 are swingably mounted on a shaft 41. As the arms 40 are swung about the shaft 41, the pulleys 39 and the lower guide plates 37 are moved closer to or remoter from the accumulation station 33. Reference numeral 42 in the Figures designates belts trained over the pulleys 39 mounted on the shaft 38 and pulley blocks **18*a* mounted on the shaft 41**.

At the both sides of the accumulation station 33 adjacently thereto provided are a belt conveyer assembly 16 and another belt conveyer assembly 18. The belt conveyer assembly 16 comprises a plurality of upper pulley block sets **16*a*, a plurality of lower pulley block pairs 16*a* and a plurality of belts 16*b* and 16*b* respectively trained over the upper pulley block sets and the lower pulley block pairs, the upper and lower belts 16*b* and 16*b* are located such that the lower run of the upper belt engages with the upper run of the lower belt to bite the bundle of bank notes A formed at the accumulation station 33 therebetween to convey the same to a first discharge port 15. The belt conveyer assembly 18 is of similar construction as the assembly 16 except in that pulley blocks 18*c*, 18*c* are disposed and the lower belts 18*b*, 18*b* are divided into two between which a gap is formed (FIG. 4). A reject fork 43 is swingably mounted between the pulleys 18*c*, 18*c* so that said gap is normally covered by the upper face of the reject fork when the bundle of bank notes is in order and a signal for dispensing the same through a second discharge port 17 is generated. If any abnormality is detected and the bundle formed at the accumulation station 33 should be rejected, for example in case where an error is involved in the counting operation or bank notes of incorrect kind are accumulated or mingled in the bundle, the reject fork 43 is actuated to swing to the upper position as shown by the dot-and-dash line in FIG. 4 to guide the bundle to a reject box 44. Numeral 45 in the Figures designates schematically a motor for the delivery operation and numeral 46** designates also schematically another motor for the dispensing operation.

The aforementioned discharge roller 36 may be moved in a position at which it does not project through the upper guide plate 35 during the accumulation operation and then moved in a position at which it projects through the plate 35 after the bank note accumulation operation has been completed.

The operation of the bank note dispenser embodying the present invention and described hereinbefore will be described below.

Bank notes A are successively pulled out of the selected bank note stacker 11 one by one by the corresponding suction head 12, and delivered to the conveyer line 13 to be conveyed to the bank note accumulator assembly 14. Each of the thus conveyed bank notes A is passed by the conveyer assembly and the kick roller 28 to the underside of one set of the paddles 31 of the paddle wheels 29 which are rotated in the clockwise direction in the illustrated embodiment. Each bank note is transferred, while being inserted in-between the adjacent paddles, further to a position at which the leading end thereof abuts against the abutting plate 34. Whereupon, the bank note A is pushed out of the paddles and at the same time the trailing end of the bank note is kicked upward by the action of the kick roller 28, as best seen from FIG. 6. As a result, the bank notes A are successively accumulated at the accumulation station 33 as shown in FIG. 6. After a desired number of bank notes A has been accumulated, the arms 40 are swung about the shaft 41 in the clockwise direction to move the lower guide plates 37 and the pulleys 39 to the upper positions, whereby the bundle of accumulated bank notes A is pinched or clamped in-between the belts 42 and the discharge roller 36.

If it is desired to discharge the bundle of bank notes A through the first discharge port 15, the belt 42 is moved in the direction shown by the arrow X in FIG. 7 to pass the bundle of bank notes to the belt conveyer assembly 16. Then, the arms 26, 26 carrying the kick roller 28 are swung upward so that the bundle is pressed onto the upper belt 16*b*. Thereafter, the bundle of bank notes is discharged through the first discharge port 15 by the co-operative actions of the kick roller 28 and the belt conveyer assembly 16.

On the other hand, if it is desired to discharge the bundle of bank notes A through the second discharge port 17, the abutting plate 34 is swung about the shaft 41 in the counter-clockwise direction as shown in FIG. 7, and then the belt 42 is moved in the direction shown by the arrow Y to pass the bundle to the belt conveyer assembly 18 by which the bundle is conveyed to the discharge port 17.

If the accumulated bundle of bank notes A is in any objectional condition and should be rejected, the reject fork 43 is erected as shown by the dot-and-dash line in FIG. 2 to guide the bundle to the reject box 44.

As will be clear from the foregoing description, using the paper sheet accumulator assembly according to the invention wherein one or a plurality of paddle wheels each provided with swirling paddles for receiving the conveyed paper sheet separately between the underside of one paddle and the upside of the next adjacent paddle, the paper sheet just being treated to accumulate at the accumulation station is prevented from contacting the bottom face of the already accumulated paper sheet. Accordingly, the paper sheets may be accumulated at the accumulation station readily in good order without jamming or misalignment caused by broken, folded, undulating or too soft paper sheet or sheets other wise occurred by the use of the conventional device. Moreover, by the use of the paper sheet accumulator assembly of the present invention, a bank note dispenser of compact size provided with two-way discharge ports may be easily manufactured at a reasonable cost.

Although the present invention has been described while referring to a preferred embodiment thereof, it should be appreciated that the foregoing disclosure and the showings made in the drawings are merely illustrative of the principles of the invention and are not to be interpreted in a limiting sense.

What is claimed is:

1. A bank note dispenser having first and second discharge ports provided at the opposed side walls of the frame of the dispenser, which comprises a plurality of bank note stackers each stocking a single kind of bank notes, suction means for sucking a selected kind of bank notes successively from a selected stacker selected from said plurality of bank note stackers, first conveyer means for receiving the bank notes from said suction means to convey the same, a bank note accumulator assembly for successively receiving the bank notes conveyed by said first conveyer means to underlay the same in good order at a collection station to form a bundle of bank notes, second conveyer means for conveying said bundle of bank notes from said collection station selectively along a passage directing to said first discharge port, and third conveyer means for conveying said bundle of bank notes from said collection station selectively along a passage directing to said second discharge port, said bank note accumulator assembly including a paddle wheel disposed downstream of said first conveyer means for delivering bank notes to the accumulator assembly and having a plurality of swirling paddles overlapping with each other, said paddle wheel being carried for rotating to receive bank notes underside of said paddles such that one bank note is inserted under each paddle, an abutting plate disposed adjacently to said paddle wheel for abutting against the leading ends of said bank notes inserted underside of said paddles, and a kick roller for pushing the bank notes and kicking the trailing ends of said bank notes upward to kick out them from the underside of the paddles.

2. A bank note dispenser having first and second discharge ports provided at the opposed side walls of the frame of the dispenser according to claim 1, further comprising feeding means for feeding said bundle of bank notes selectively to said second and third conveyer means, said feeding means including a guide plate being swingably moved between a lower position for guiding bank notes to said paddle wheel during the accumulation operation and an upper position for supporting the underside of the bundle of accumulated bank notes when the accumulation operation is completed, and a roller pair for releasingly engaging with each other while pinching said bundle of accumulated bank notes therebetween and capable of rotating selectively in one direction to feed said bundle of accumulated bank notes to said second conveyor means and in the reverse direction to feed said bundle of accumulated bank notes to said third conveyer means.

3. A bank note dispenser having first and second discharge ports provided at the opposed side walls of the frame of the dispenser according to claim 1, further comprising an assembly for receiving any rejected bundles of bank notes, said last mentioned assembly including a reject box for receiving and storing said rejected bundles of bank notes and mounted beneath either of said second or third conveyer means, and a reject fork swingably mounted above said reject box to extend over an opening of said reject box at the normal position and to be actuated to swing to the raised position for guiding the rejected bundles of bank notes to said reject box in response to signals instructing to reject the discharge of said rejected bundles.

4. A bank note dispenser having first and second discharge ports provided at the opposed side walls of the frame of the dispenser according to claim 1, wherein said bank note accumulator assembly has a plurality of paddle wheels, and said abutting plate has a downward projecting lug which extends over the gap formed between the adjacent paddle wheels to scoop up the leading ends of bank notes.

5. A bank note dispenser having first and second discharge ports provided at the opposed side walls of the frame of the dispenser according to claim 1, wherein said swirling paddles are outwardly extending from the paddle wheel in a direction opposite to the rotating direction of said paddle wheel to be gradually separated from the outer periphery of the wheel to which said paddles are implanted, and a gap for receiving a bank note is formed between the underside of each paddle and the upside of the next paddle.

* * * * *